US006650208B2

(12) United States Patent
Karhu

(10) Patent No.: US 6,650,208 B2
(45) Date of Patent: Nov. 18, 2003

(54) DUAL-MODE RESONATOR

(75) Inventor: Kimmo Kalervo Karhu, Oulu (FI)

(73) Assignee: Remec Oy, Oulu (FI)

( * ) Notice: Subject to any disclaimer, the term of this patent is extended or adjusted under 35 U.S.C. 154(b) by 0 days.

(21) Appl. No.: 09/876,590

(22) Filed: Jun. 7, 2001

(65) Prior Publication Data

US 2003/0043000 A1 Mar. 6, 2003

(51) Int. Cl.[7] ..... H01P 1/20; H01P 7/10

(52) U.S. Cl. ..... 333/202; 333/219.1; 333/235

(58) Field of Search ..... 333/202, 219, 333/219.1, 235

(56) References Cited

U.S. PATENT DOCUMENTS

| | | | | | |
|---|---|---|---|---|---|
| 4,327,330 | A | * | 4/1982 | Ranghelli | 333/125 |
| 4,423,397 | A | | 12/1983 | Nishikawa et al. | 333/219 |
| 4,642,591 | A | | 2/1987 | Kobayashi | 333/227 |
| 5,325,077 | A | | 6/1994 | Ishikawa et al. | 333/219 |
| 5,642,085 | A | * | 6/1997 | Abe et al. | 333/219.1 |
| 5,710,530 | A | * | 1/1998 | Wada et al. | 333/219.1 |
| 5,796,320 | A | * | 8/1998 | Hattori et al. | 333/219.1 |
| 5,880,650 | A | * | 3/1999 | Latouche et al. | 333/202 |
| 6,262,639 | B1 | * | 7/2001 | Shu et al. | 333/202 |
| 6,433,652 | B1 | * | 8/2002 | Hattori et al. | 333/202 |

FOREIGN PATENT DOCUMENTS

| | | | | |
|---|---|---|---|---|
| JP | 63187703 A | * | 8/1988 | 333/219.1 |

OTHER PUBLICATIONS

Fernando, et al., "Dual–mode $TE_{01\delta}$ dielectric resonator," *29th European Microwave Conference—Munich,* pp. 51–54 (1999).

Hunter, et al., "Dual–mode filters with conductor–loaded dielectric resonators," *IEEE Transactions on Microwave Theory and Techniques 47*:2304–2311 (1999).

Mansour, et al., "Quasi dual–mode resonators," *IEEE*(2000).

Nishikawa, et al., "800 MHz band dielectric channel dropping filter using $TM_{110}$ triple mode resonance," *IEEE MTT–S Digest,* pp. 289–292 (1985).

* cited by examiner

*Primary Examiner*—Seungsook Ham
(74) *Attorney, Agent, or Firm*—Heller Ehrman White & McAuliffe

(57) ABSTRACT

A TE dual-mode resonator is provided. The TE dual-mode resonator has first and second modes. The resonator includes an enclosure having a cavity with an interior surface. The resonator further includes a dielectric resonator body, having a central portion with a plurality of members extending outwardly from the central portion. The dielectric resonator body is coupled directly to the interior surface.

42 Claims, 4 Drawing Sheets

DUAL-MODE RESONATOR

TECHNICAL FIELD

The present invention relates generally to the field of filters and, in particular, to a dual-mode resonator for use in, for example, a cavity filter.

BACKGROUND

Wireless telecommunications systems transmit signals to and from wireless terminals using radio frequency (RF) signals. A typical wireless system includes a plurality of base stations that are connected to the public switched telephone network (PSTN) via a mobile switching center (MSC). Each base station includes a number of radio transceivers that are typically associated with a transmission tower. Each base station is located so as to cover a geographic region known colloquially as a "cell."Each base station communicates with wireless terminals, e.g. cellular telephones, pagers, and other wireless units, located in its geographic region or cell.

A wireless base station includes a number of modules that work together to process RF signals. These modules typically include, by way of example, mixers, amplifiers, filters, transmission lines, antennas and other appropriate circuits. One type of filter that finds increased use in wireless base stations is known as a microwave cavity filter. These cavity filters include a number of resonators formed in a plurality of cavities so as to provide a selected frequency response when signals are applied to an input of the filter.

One type of resonator structure used in these cavity filters is the dual-mode resonator. The use of dual-mode resonators allows a given filter function to be realized with a smaller size than conventional single mode resonators. Unfortunately, current dual-mode resonators suffer from one or more of various problems. First, many dual-mode resonators are difficult to manufacture due to the shape of the resonator structure, e.g., spherical structures. Further, other dual-mode resonators are too bulky for specific applications. Other problems with existing structures relate to poor heat transfer, limited bandwidth, and difficulties in placing tuning members on the structure.

For the reasons stated above, and for other reasons stated below which will become apparent to those skilled in the art upon reading and understanding the present specification, there is a need in the art for an improved dual-mode resonator.

SUMMARY

The above mentioned problems with dual-mode resonators and other problems are addressed by embodiments of the present invention and will be understood by reading and studying the following specification. Embodiments of the present invention provide a dual-mode resonator that has a cross-like shape and is fixable directly to a surface of an enclosure. In some embodiments, all tuning elements of the dual-mode resonator are provided in the same surface of the enclosure. In some embodiments the shape of the dielectric body is a cross and in other embodiments, the shape is an "X" shape. Further, in some embodiments, tuning grooves and tuning elements are positioned proximate the dielectric body to provide coupling between the modes. In some embodiments, a recess is provided in the bottom of the resonator to improve spurious properties.

More particularly, in one embodiment a TE dual-mode resonator is provided. The TE dual-mode resonator has first and second modes. The resonator includes an enclosure having a cavity with an interior surface. The resonator further includes a dielectric resonator body, having a central portion with a plurality of members extending outwardly from the central portion. The dielectric resonator body is coupled directly to the interior surface.

DETAILED DESCRIPTION

In the following detailed description, reference is made to the accompanying drawings that form a part hereof, and in which is shown by way of illustration specific illustrative embodiments in which the invention may be practiced. These embodiments are described in sufficient detail to enable those skilled in the art to practice the invention, and it is to be understood that other embodiments may be utilized and that logical, mechanical and electrical changes may be made without departing from the spirit and scope of the present invention. The following detailed description is, therefore, not to be taken in a limiting sense.

Embodiments of the present invention provide improvements in dual-mode resonators. These dual-mode resonators are used in, for example, cavity filters for wireless telecommunications networks. The dual-mode resonators of the various embodiments include a dielectric resonator body having a pair of crossing members. Each of the embodiments described below provides various features and advantages that are distinct from existing dual-mode resonators.

Figure 1:
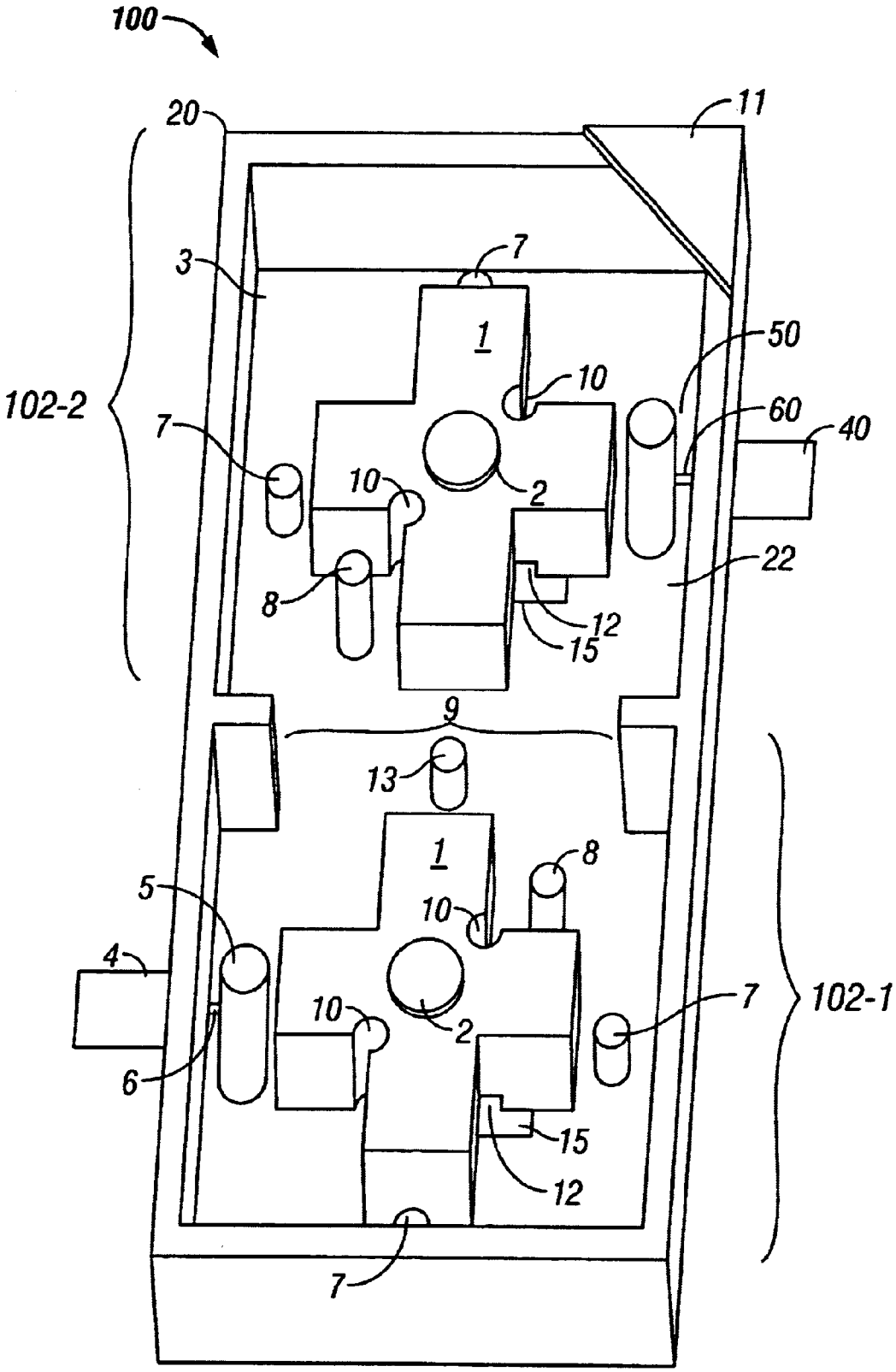
FIG. 1 is a perspective view of one embodiment of a filter including dual-mode resonators according to the teachings of the present invention.

FIG. 1 is a perspective view of one embodiment of a filter, indicated generally at 100, including dual-mode resonators, 102-1, and 102-2 according to the teachings of the present invention. Filter 100 is a 4-pole dual-mode filter. Dual-mode resonators 102-1 and 102-2 are constructed in a similar manner. Therefore, only the dual-mode resonator 102-1 is described in detail.

Dual-mode resonator 102-1 includes resonator body 1. In one embodiment, resonator body 1 comprises a pair of members that cross at a midpoint of each member as shown in FIG. 1. In one embodiment, resonator body 1 works as two half cut $TE_{01}$ resonators. In other embodiments, the crossing members form other shapes such as shown and described below with respect to FIGS. 3, 4, 5, 6, 7A and 7B, 8A and 8B, 9 and 10.

Resonator body 1 comprises a low loss dielectric material. For example, in one embodiment, resonator body 1 comprises a ceramic or other dielectric material with a dielectric constant (Er) between 36 and 45. These kinds of materials include, for example, 4500 series ceramic material from Trans-Tech, Inc., Adamstown, Md. or K4500 ceramic material from EDO Electro-Ceramics, Salt Lake City, Utah. These materials have good loss properties. In other embodiments, materials are selected with a dielectric constant that is suited to the particular application.

In one embodiment, resonator body 1 is pressed from an appropriate material, e.g., an appropriate ceramic material. Thus, the shape of resonator body 1 provides the advantage of ease of production by allowing the resonator body to be formed by a simple pressing function. In other embodiments, resonator body 1 is formed using additional machining steps to achieve a desired shape and structure.

Resonator body 1 is attached on interior surface 22 of cavity 3 of enclosure 20. This direct connection to enclosure 20 provides improvement in heat dissipation for filter 100. In one embodiment, enclosure 20 is formed from a conductive material, e.g., a metal. Resonator body 1 is attached, in one embodiment, by a low loss dielectric, e.g., plastic, screw 2. In other embodiments, resonator body 1 is attached using low loss adhesive or soldering with silver sintering on the bottom of resonator body 1. In other embodiments, resonator body 1 is coupled to a separate metal or metalized support or a thin low loss dielectric support. Such support is coupled to surface 22 of enclosure 20. Enclosure 20 also includes conductive cover 11 on the top of cavity 3.

Dual-mode resonator 102-1 includes an input connector 4 that is adapted to receive radio frequency (RF) signals for processing by filter 100. Input connector 4 is coupled by conductive coupling wire 6 to conductive coupling tap 5. Conductive coupling tap 5 is attached to surface 22 of cavity 3. Similarly, dual-mode resonator 102-2 includes an output connector 40 that is adapted to provide a filter output signal from filter 100. Output connector 40 is coupled by conductive coupling wire 60 to conductive coupling tap 50. Conductive coupling tap 50 is attached to surface 22 of cavity 3.

Figure 4:
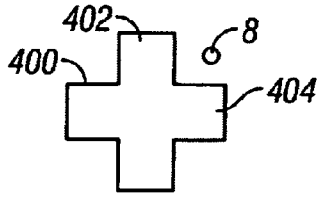
FIG. 4 is a top view of another embodiment of a dielectric resonator body with a mode tuning member according to the teachings of the present invention.
Figure 5:
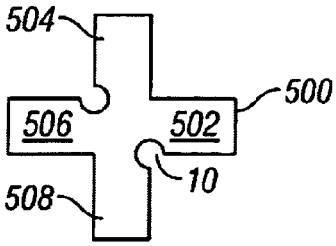
FIG. 5 is a top view of another embodiment of a dielectric resonator body with coupling grooves according to the teachings of the present invention.

Dual-mode resonator 102-1 includes a mechanism for coupling the first and second modes. In one embodiment, the dual-mode resonator 102-1 includes mode coupling grooves 10 that cause an internal coupling to the second mode. In one embodiment, dual-mode resonator 102-1 also includes mode-tuning members 8. In one embodiment, mode-tuning members 8 comprise screws. In other embodiments, mode-tuning members 8 comprise a metal part that can be bent. Mode-tuning members 8 are used to fine-tune the internal couplings between the first and second modes. As depicted in FIG. 4, other embodiments provide for coupling between modes using only mode tuning members 8. Further, as depicted in FIG. 5, other embodiments provide coupling between modes using coupling grooves 10 only. As shown here in FIG. 1 and in FIG. 6, some embodiments use both coupling grooves 10 and mode tuning members 8.

Further, in some embodiments, dual-mode resonator 102-1 also includes frequency tuning members 7. In one embodiment, frequency tuning members 7 comprise screws. In other embodiments, frequency tuning members 7 comprise a metal part that can be bent toward or away from dielectric resonator body 1. Frequency tuning members 7 fine-tune the resonant frequencies of the modes. In one embodiment, frequency tuning members 7 are made from a conductive material or some high dielectric constant material or some composite structure.

As shown in FIG. 1, frequency tuning members 7 and mode tuning members 8 are formed on the same side of resonator body 1 and on surface 22 of enclosure 20. In other embodiments, tuning members 7 and mode tuning members 8 are selectively placed on any appropriate side of resonator body 1 and on any appropriate surface of enclosure 20.

Figure 2:
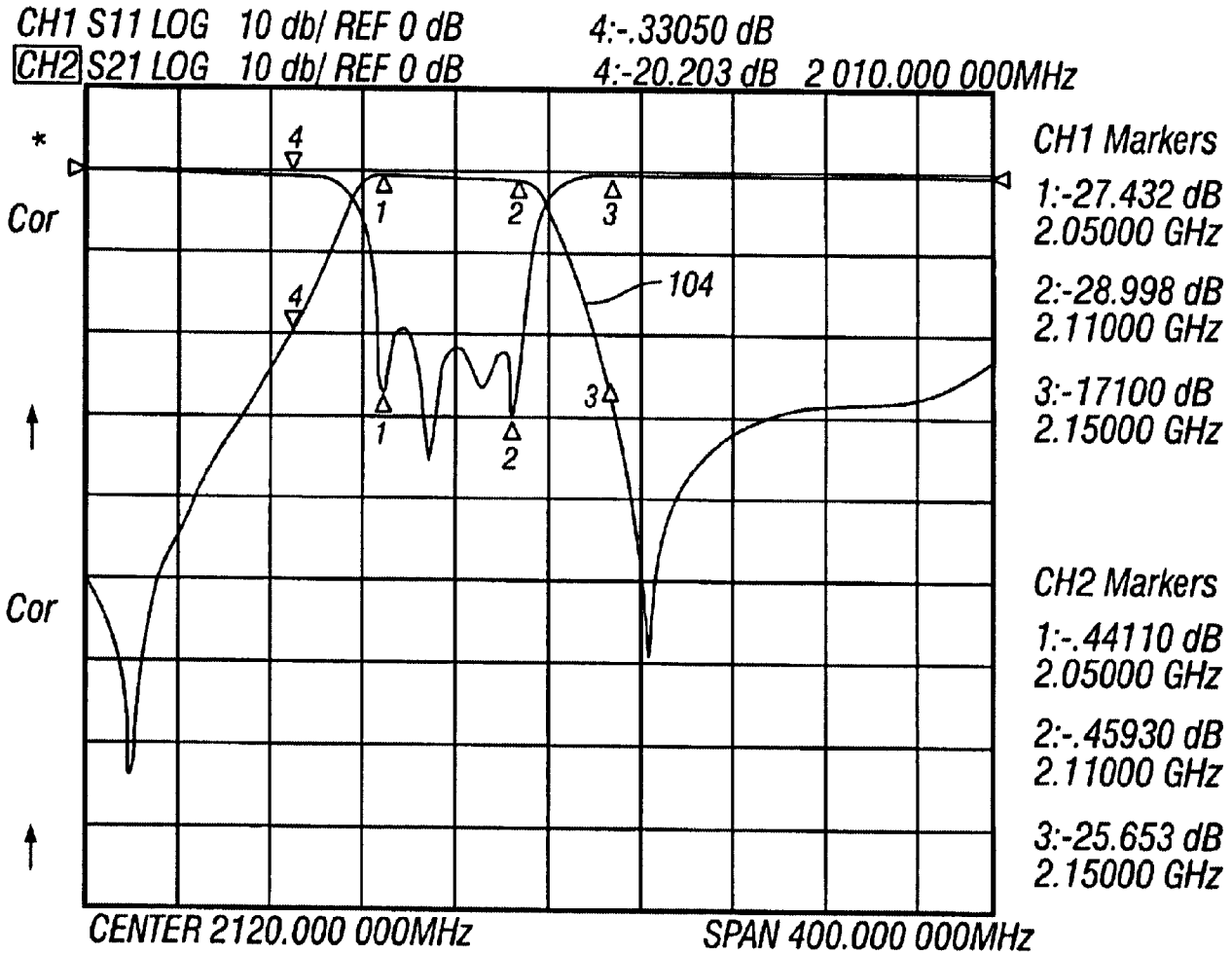
FIG. 2 is a graph that illustrates a sample of a frequency response for the filter of FIG. 1 according to one embodiment of the present invention.

Dual-mode resonators 102-1 and 102-2 are coupled together to provide an appropriate frequency response for filter 100. For example, in one embodiment, filter 100 has the frequency response of curve 104 of FIG. 2. Dual-mode resonators 102-1 and 102-2 are coupled together through opening 9 in enclosure 20. This is referred to as the "external" coupling of the two dual-mode resonators. In one embodiment, the external coupling is fine tuned by conductive screw 13.

In one embodiment, resonator body 1 includes recess 12 on a bottom surface. Recess 12 shifts TM-mode spurious signals toward higher frequencies but does not have much effect on the dominant TE-modes. In one embodiment, a matching recess 15 is also formed in surface 22 of enclosure 20.

The resonance frequency of dual-mode resonator 102-1 is determined by a number of factors. These factors include: resonator shape, resonator size, cavity size, location of the resonator body in the cavity, the dielectric constant of the material used to fabricate the resonator body, and the positioning and operation of any tuning members. It has been determined that a resonator body functions appropriately when the height is approximately one-half of the width and the thickness of the members is approximately the width divided by 2.5. The exact dimensions for an implementation of dual-mode resonator 102-1 also depend on the specific use of the filter and the dimensions can be changed based on trade-offs with respect to Q value, size, spurious properties, and environmental matters.

In some embodiments, the resonance frequencies of the dominant modes are different. This can be handled with tuning members 7. However, if a large difference in resonance frequency is required, the size and shape of the various members of the resonator body can be varied to achieve the desired resonance frequency, e.g., length, thickness, shape. Further, a recess in the bottom of the resonator body can also be used.

In operation, filter 100 filters a signal received at input connector 4 Y using dual-mode resonators 102-1 and 102-2. The signal couples from tap 5 to a first frequency mode of resonator body 1 of dual-mode resonator 102-1. Coupling grooves 10 and mode tuning members 8 cause the fields of the first and second mode to turn so as to couple the first and second modes. The frequency of signals passed by dual-mode resonator 102-1 is adjusted by frequency tuning members 7.

The signal from dual-mode resonator 102-1 is coupled through opening 9 to dual-mode resonator 102-2. The signal is filtered and further passed to output connector 40.

It is understood that in this description that the term "conductive material" includes metals and metal plated material because at very high frequencies current flows in a very thin layer at conductor surface (inner surface of outer contact, outer surface of inner contact). This state is called the skin effect. For example, enclosure 20 operates as an outer surface.

Figure 3:
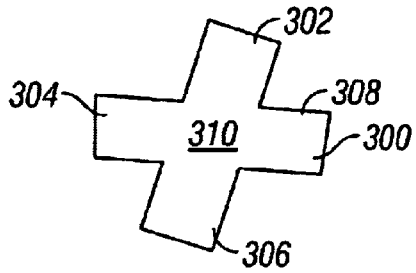
FIG. 3 is a top view of another embodiment of a dielectric resonator body according to the teachings of the present invention.

FIG. 3 is a top view of another embodiment of a dielectric resonator body, 300, according to the teachings of the present invention. In this embodiment, coupling between the first and second modes is accomplished without the use of coupling grooves or mode tuning members. In this embodiment, resonator body 300 has an "X" shape. This means that members 302, 304, 306 and 308 extend radially from central portion 310 in a manner such that the angle at the intersection of two adjacent members is not 90 degrees. In effect, this "turns" the fields enough to cause internal coupling without the use of the grooves or mode tuning members. It is noted that the coupling between modes increases the further the angle is from 90 degrees.

FIG. 4 is a top view of another embodiment of a dielectric resonator body, 400, with a mode tuning member 8 according to the teachings of the present invention. In this embodiment, coupling between the first and second modes is accomplished solely through the use of mode tuning member 8, e.g., a metal screw. In this embodiment, mode tuning member 8 is disposed in a location adjacent to an intersection between members 402 and 404 of resonator body 400.

FIG. 5 is a top view of another embodiment of a dielectric resonator body, 500, according to the teachings of the present invention. In this embodiment, coupling between the first and second modes is accomplished solely through the use of mode coupling grooves 10. In this embodiment, coupling grooves 10 are formed at intersections between members 502 and 508 and between members 504 and 506 of resonator body 500.

Figure 6:
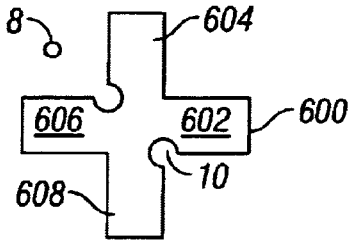
FIG. 6 is a top view of another embodiment of a dielectric resonator body with a mode tuning member and coupling grooves according to the teachings of the present invention.

FIG. 6 is a top view of another embodiment of a dielectric resonator body 600 with a mode tuning member 8 and coupling grooves 10 according to the teachings of the present invention. In this embodiment, coupling between the first and second modes is accomplished through the use of mode tuning member 8, e.g., a metal screw, and coupling grooves 10. In this embodiment, mode tuning member 8 is disposed in a location adjacent to an intersection between members 604 and 606 of resonator body 400. Coupling grooves 10 are formed at intersections between members 602 and 608 and between members 604 and 606 of resonator body 600. Thus, tuning member 8 is disposed adjacent to one of coupling grooves 10.

As shown in FIGS. 4, 5, and 6, tuning members and coupling grooves can be used, alone or together, to couple between the first and second modes. The use of tuning members allows the coupling to be adjusted. However, the tuning members also decrease the Q-value of the resonator. The groove coupling has a minor effect on the Q-value but is not easy to tune. The combination of a tuning member with a coupling groove, e.g., as shown in FIG. 6, provides the advantage of the reduced effect on the Q-value and the ability to fine-tune the coupling between modes. When a tuning screw is located at the same side of the resonator as the groove as shown in FIG. 6, coupling increases when the screw becomes longer. When a tuning screw is located on the other side of the resonator body so that it is not located adjacent to the groove, coupling increases when the screw becomes shorter. When a metal part is used, the coupling is adjusted by bending the metal part toward or away from the resonator body. It is also noted that the effect of the tuning member is stronger the closer the tuning member is to the resonator body. In a specific application, the positioning of the tuning member is a compromise between electrical (frequency or coupling) and mechanical (physical location) constraints.

Figure 7A:
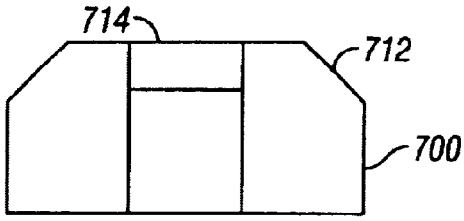
FIGS. 7A and 7B are side and top views, respectively, of an embodiment of a dielectric resonator body with a partially angled top portion according to the teachings of the present invention.
Figure 7B:
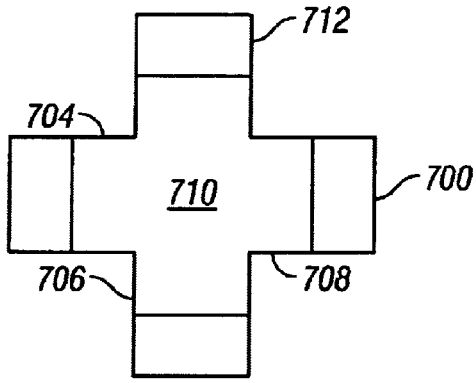

FIGS. 7A and 7B are side and top views, respectively, of a dielectric resonator body 700 with a partially angled top portion according to the teachings of the present invention. Resonator body 700 includes members 702, 704, 706, and 708 which extend radially from central portion 710. Each of members 702, 704, 706, and 708 include a portion, 712, that is angled with respect to top surface 714 of central portion 710.

Angled portions 712 do not affect the dominant modes because their E-field has a half circular shape in this resonator. However, angled portions 712 shift the $TM_{01}$-mode towards a higher frequency. This spurious $TM_{01}$-mode can cause problems in the filter, even though there can be other spurious modes at lower frequency. The $TM_{01}$ is more of a problem because it has much stronger coupling than other modes.

Figure 8A:
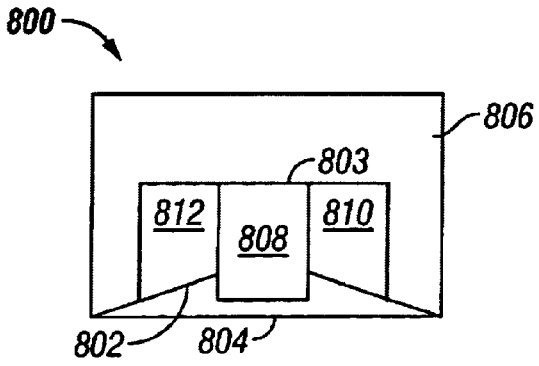
FIGS. 8A and 8B are side and top views, respectively, of an embodiment of a dielectric resonator body with a partially angled bottom portion according to the teachings of the present invention.
Figure 8B:
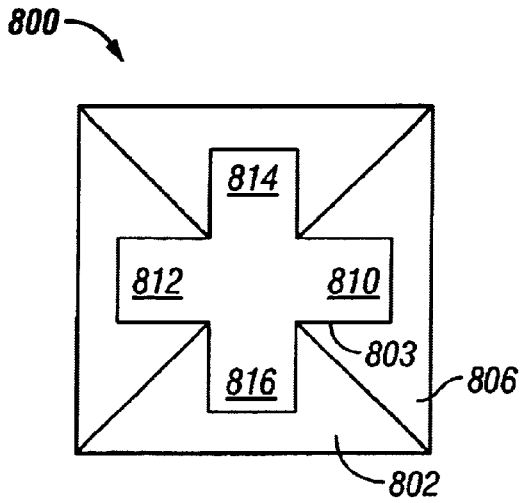

FIGS. 8A and 8B are side and top views, respectively, of another embodiment of a dual-mode resonator, indicated generally at 800, according to the teachings of the present invention. In this embodiment, dual-mode resonator 800 includes resonator body 803 that has an angled bottom. Specifically, resonator body 803 has portion 802 that is formed at an angle with respect to surface 804 of enclosure 806. In this embodiment, central portion 808 extends below bottom surface 802 of members 810, 812, 814, and 816.

Figure 9:
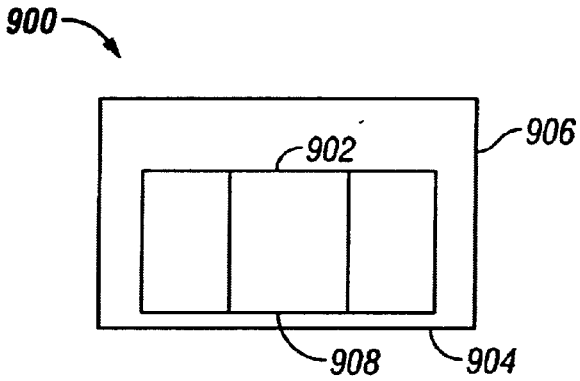
FIG. 9 is a side view of another embodiment of a dielectric resonator structure according to the teachings of the present invention.

FIG. 9 is a side view of another embodiment of a dual-mode resonator, indicated generally at 900, according to the teachings of the present invention. In this embodiment, resonator body 902 is separated from surface 904 of enclosure 906 by a selected distance. By placing resonator body 902 at a distance from surface 904, the resonance frequency is shifted to a higher frequency. Further, the Q value also increases. However, the dominant modes also shift closer to spurious modes. The resonance frequency can also be modified by modification of bottom 908 to include, for example, a recess to reduce the effect of the shift of the dominant modes toward the spurious modes.

Figure 10:
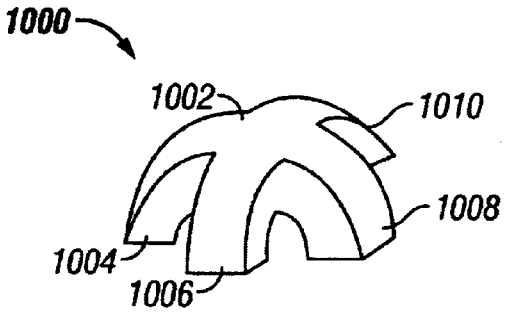
FIG. 10 is a perspective view of another embodiment of a dielectric resonator structure according to the teachings of the present invention.

FIG. 10 is a perspective view of another embodiment of a resonator body, indicated generally at 1000, and constructed according to the teachings of the present invention. Resonator 1000 includes central portion 1002 and members 1004, 1006, 1008 and 1010 that extend radially from central portion 1002. In this embodiment, members 1004, 1006, 1008, and 1010 form arcs that cross at central portion 1002. The shape of resonator 1000 improves electrical characteristics of the resonator, e.g., spurious properties.

Although specific embodiments have been illustrated and described in this specification, it will be appreciated by those of ordinary skill in the art that any arrangement that is calculated to achieve the same purpose may be substituted for the specific embodiment shown. This application is intended to cover any adaptations or variations of the present invention.

What is claimed is:

1. A TE dual-mode resonator having first and second modes, the resonator comprising:

an enclosure having a cavity with an interior surface;

a TE dielectric resonator body, having a central portion with a plurality of members extending outwardly from the central portion; and a bottom surface of the dielectric resonator body coupled directly to only one wall of the interior surface.

2. The TE dual-mode resonator of claim 1, wherein the dielectric resonator body comprises a cross shape.

3. The TE dual-mode resonator of claim 1, wherein the dielectric resonator body comprises an "X" shape.

4. The TE dual-mode resonator of claim 1, wherein the dielectric resonator body includes at least one coupling groove positioned in the dielectric resonator body at an intersection of the central portion and at least two of the members.

5. The TE dual-mode resonator of claim 1, and further including a mode tuning member that is positioned between adjacent two of the plurality of members.

6. The TE dual-mode resonator of claim 4, and further including a mode tuning member that is positioned adjacent to one of the at least one coupling grooves.

7. The TE dual-mode resonator of claim 1, wherein the members of the dielectric resonator body have a top surface with an angled portion.

8. The TE dual-mode resonator of claim 1, wherein only a portion of a bottom surface of the dielectric resonator body contacts the interior surface of the enclosure.

9. The TE dual-mode resonator of claim 1, wherein the dielectric resonator body includes a recess in the central portion that is positioned adjacent to the interior surface of the enclosure.

10. The TE dual-mode resonator of claim 9, wherein the interior surface of the enclosure further includes a recess that is positioned adjacent to a recess in the central portion.

11. A TE dual-mode resonator having first and second modes, the resonator comprising:

an enclosure having a cavity with an interior surface;

a TE dielectric resonator body, having a central portion with a plurality of members extending outwardly from the central portion;

a bottom surface of the dielectric resonator body coupled directly to only one wall of the interior surface of the enclosure;

at least one mode tuning member extending from the interior surface of the cavity, the at least one mode tuning member disposed adjacent to the central portion of the dielectric resonator body to provide tuning for coupling between the first and second modes; and at least two frequency tuning members extending from the same surface as the at least one mode tuning member, the at least two frequency tuning members positioned adjacent to selected members of the dielectric resonator body to provide frequency tuning.

12. The TE dual-mode resonator of claim 11, wherein the dielectric resonator body comprises a cross shape.

13. The TE dual-mode resonator of claim 11, wherein the dielectric resonator body comprises an "X" shape.

14. The TE dual-mode resonator of claim 11, wherein the dielectric resonator body includes at least one coupling groove positioned in the dielectric resonator body at an intersection of the central portion and at least two of the members.

15. The TE dual-mode resonator of claim 11, wherein the members of the dielectric resonator body have a top surface with an angled portion.

16. The TE dual-mode resonator of claim 11, wherein only a portion of a bottom surface of the dielectric resonator body contacts the interior surface of the enclosure.

17. The TE dual-mode resonator of claim 11, wherein the dielectric resonator body includes a recess in the central portion that is positioned adjacent to the interior surface of the enclosure.

18. The TE dual-mode resonator of claim 17, wherein the interior surface of the enclosure further includes a recess that is positioned adjacent to a recess in the central portion.

19. A TE dual-mode resonator having first and second modes, the resonator comprising:

an enclosure having a cavity with an interior surface;

a recess formed in the interior surface;

a dielectric resonator body, having a central portion with a plurality of members extending outwardly from the central portion;

the dielectric resonator body further including a recess in one surface of the central portion;

the dielectric resonator body disposed such that the recess of the dielectric resonator body is proximate the recess in the interior surface of the cavity;

at least one mode tuning member extending from the surface of the cavity, the at least one mode tuning member disposed adjacent to the central portion of the dielectric resonator body to provide tuning for coupling between the first and second modes; and at least two frequency tuning members extending from the same surface as the at least one mode tuning member, the at least two frequency tuning members positioned adjacent to selected members of the dielectric resonator body to provide frequency tuning.

20. The TE dual-mode resonator of claim 19, wherein the dielectric resonator body comprises a cross shape.

21. The TE dual-mode resonator of claim 19, wherein the dielectric resonator body comprises an "X" shape.

22. A TE dual-mode resonator having first and second modes, the resonator comprising:

an enclosure having a cavity with an interior surface;

a dielectric resonator body, having a central portion with four members extending radially from the central portion;

a bottom surface of the dielectric resonator body coupled directly to only one wall of the interior surface;

at least one mode tuning member extending from the interior surface of the cavity, the at least one mode tuning member disposed adjacent to the central portion of the dielectric resonator body to provide tuning for coupling between the first and second modes; and at least two frequency tuning members extending from the same surface as the at least one mode tuning member, the at least two frequency tuning members positioned adjacent to selected members of the dielectric resonator body to provide frequency tuning.

23. A TE dual-mode resonator having first and second modes, the resonator comprising:

an enclosure having a cavity with an interior surface;

a dielectric resonator body having crossing members;

a bottom surface of the dielectric resonator body coupled directly to only one wall of the interior surface of the enclosure; and a plurality of tuning members extending from the interior surface of the cavity, the plurality of tuning members disposed adjacent to the dielectric resonator body to provide tuning for the TE dual-mode resonator.

24. A filter, comprising:

a plurality of TE dual-mode resonators that are coupled together;

one of the plurality of TE dual-mode resonators including an input coupling;

another one of the plurality of TE dual-mode resonators including an output coupling; and wherein each of the TE dual-mode resonators includes:

an enclosure having a cavity with an interior surface, a dielectric resonator body, having a central portion with a plurality of members extending outwardly from the central portion, and a bottom surface of the dielectric resonator body is coupled directly to only one wall of the interior surface.

25. The filter of claim 24, wherein the dielectric resonator body comprises a cross shape.

26. The filter of claim 24, wherein the dielectric resonator body comprises an "X" shape.

27. The filter of claim 24, wherein the dielectric resonator body includes at least one coupling groove positioned in the dielectric resonator body at an intersection of the central portion and at least two of the members.

28. The filter of claim 24, and further including a mode tuning member that is positioned between adjacent two of the plurality of members.

29. The filter of claim 27, and further including a mode tuning member that is positioned adjacent to one of the at least one coupling grooves.

30. The filter of claim 24, wherein the members of the dielectric resonator body have a top surface with an angled portion.

31. The filter of claim 24, wherein only a portion of a bottom surface of the dielectric resonator body contacts the interior surface of the enclosure.

32. The filter of claim 24, wherein the dielectric resonator body includes a recess in the central portion that is positioned adjacent to the interior surface of the enclosure.

33. The filter of claim 32, wherein the interior surface of the enclosure further includes a recess that is positioned adjacent to a recess in the central portion.

34. A TE dual-mode resonator having first and second modes, the resonator comprising:

an enclosure having a cavity with an interior surface;

a TE dielectric resonator body, having a central portion with a plurality of members extending outwardly from the central portion; and a bottom surface of the dielectric resonator body coupled to only one wall of the interior surface.

35. The TE dual-mode resonator of claim 34, wherein the dielectric resonator body comprises a cross shape.

36. The TE dual-mode resonator of claim 34, wherein the dielectric resonator body comprises an "X" shape.

37. The TE dual-mode resonator of claim 34, wherein the dielectric resonator body includes at least one coupling groove positioned in the dielectric resonator body at an intersection of the central portion and at least two of the members.

38. The TE dual-mode resonator of claim 34, and further including a mode tuning member that is positioned between adjacent two of the plurality of members.

39. The TE dual-mode resonator of claim 37, and further including a mode tuning member that is positioned adjacent to one of the at least one coupling grooves.

40. The TE dual-mode resonator of claim 34, wherein the members of the dielectric resonator body have a top surface with an angled portion.

41. The TE dual-mode resonator of claim 34, wherein only a portion of a bottom surface of the dielectric resonator body contacts the interior surface of the enclosure.

42. The TE dual-mode resonator of claim 34, wherein the dielectric resonator body includes a recess in the central portion that is positioned adjacent to the interior surface of the enclosure.

* * * * *